US009642442B2

(12) United States Patent
Pires et al.

(10) Patent No.: US 9,642,442 B2
(45) Date of Patent: May 9, 2017

(54) WIPER FOR A CONTAINER

(71) Applicant: Zen Design Solutions Limited, Kowloon (HK)

(72) Inventors: Leo Clifford Pires, Basking Ridge, NJ (US); Roger Hwang, Maple (CA); Rahul Bose, New Delhi (IN); Iti Seth, Faridabad (IN); Smita Srivastava, New Delhi (IN); Rajesh Deswal, Rohtak (IN)

(73) Assignee: ZEN DESIGN SOLUTIONS LIMITED, Kowloon, Hong Kong (CN)

( * ) Notice: Subject to any disclaimer, the term of this patent is extended or adjusted under 35 U.S.C. 154(b) by 267 days.

(21) Appl. No.: 14/579,737

(22) Filed: Dec. 22, 2014

(65) Prior Publication Data

US 2015/0182005 A1 Jul. 2, 2015

(30) Foreign Application Priority Data

Dec. 31, 2013 (IN) ..... 3835/DEL/2013

(51) Int. Cl.
*A45D 40/26* (2006.01)
*A45D 34/04* (2006.01)

(52) U.S. Cl.
CPC ..... *A45D 40/267* (2013.01); *A45D 34/046* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,627,619 | A | 2/1953 | Gagen | |
| 4,810,122 | A | 3/1989 | Cole | |
| 6,280,112 | B1 * | 8/2001 | Vieu | A45D 34/042 401/122 |
| 7,334,584 | B2 * | 2/2008 | Mathiez | A45D 40/267 132/218 |
| 8,142,093 | B2 | 3/2012 | Vanoncini | |
| 2001/0038769 | A1 * | 11/2001 | Gueret | A45D 40/267 401/122 |
| 2013/0101336 | A1 * | 4/2013 | Kulik | A45D 34/046 401/122 |

* cited by examiner

*Primary Examiner* — David Walczak
(74) *Attorney, Agent, or Firm* — Patterson + Sheridan, LLP

(57) ABSTRACT

A wiper which seals the container upon withdrawal of an applicator from the container. The wiper comprises an upper part and a lower part which is a sealing part, and wherein the sealing part is a self-sealing resilient structure. In a closed state of the sealing part, the sealing part forms a seal at a distal end of the wiper and in an open state, an opening is formed at the distal end of the wiper, when the applicator is inserted into the wiper. The wiper of the present disclosure can be employed in the container used for application of cosmetic or care products include viscous cosmetics, mascara, eye liner, lip gloss, hair color and like products.

16 Claims, 9 Drawing Sheets

WIPER FOR A CONTAINER

CROSS-REFERENCE TO RELATED APPLICATION

This application claims benefit of Indian Provisional Application Ser. No. 3835/DEL/2013, filed Dec. 31, 2013, which is incorporated by reference in its entirety.

BACKGROUND

Field of the Invention

Embodiments of the present disclosure generally relate to a wiper for a container for packaging and dispensing cosmetic or care products. More particularly, the present disclosure relates to a wiper which at least partially seals a container upon withdrawal of an applicator from the container. The cosmetic or care products include viscous cosmetics, mascara, eye liner, lip gloss, hair color and like products.

Description of the Related Art

Numerous kinds of cosmetic and care products are available in the market today. Some such cosmetic products include mascara, lip gloss, eye liner or like products which are fluidic in nature.

Known in the art are containers designed to hold cosmetic products preferably in a liquid or semi-liquid form, such as mascara, and to enable application of same. Such containers comprise a receptacle usually of cylindrical shape having an opening closed by a removable cap at an end thereof. Mounted on the cap is a stem carrying an applicator, for example, in the form of a brush. When the cap is put on the container for closing it, the applicator is at the inside of the receptacle, being dipped in the cosmetic product. Within the receptacle, close to the opening, a wiper is also installed, the function of which is to eliminate, during drawing of the stem out of the receptacle, the excess cosmetic product that is present on the stem itself and on the applicator.

A wiper of known type comprises a hollow body, the shape of which matches that of the receptacle opening and inserted by interference fit into the opening itself. The hollow body at the lower part thereof has a narrowing passage usually defined by a frustoconical tailpiece of flexible material tapering towards the receptacle bottom. When the applicator is inserted into the receptacle, the tailpiece is caused to rub against the same offering a weak resistance, while when the applicator is drawn out of the receptacle; the tailpiece interferes with the stem and with the applicator's bristles to remove the excess cosmetic product there from. For example, wipers of such type are disclosed in in U.S. Pat. No. 2,627,619, U.S. Pat. No. 4,810,122, and U.S. Pat. No. 8,142,093.

Such prior art containers have been proven to be deficient in a number of respects that they typically rely only on the cap for sealing the cosmetic product contained therein from the atmosphere. However, as the applicator is withdrawn from the container, the air from outside environment enters into the container and thereby acts as a catalyst in causing drying out of the cosmetic product stored in the receptacle of the container. Moreover, the prior art containers repeatedly expose the bulk of the cosmetic product stored therein to the atmosphere during each use by the consumer. This serves to increase the risk of contamination by foreign substances such as particulate matter and microbes. Furthermore, the addition of air in the product causes the cosmetic product to become dry and lumpy. Such prior art containers are not suitable for storage and application of the cosmetic product containing a significant concentration of one or more volatile agents. Therefore, there exists a need for a wiper for a container that is user-friendly, and restricts entry of air into the container while the cap is removed.

SUMMARY

According to an embodiment of the present disclosure, there is provided a wiper for a container for packaging and dispensing cosmetic or care products. More particularly, the present disclosure relates to a wiper for a container, which seals the container upon withdrawal of an applicator from the container. More particularly, the present disclosure relates to a wiper for a container, which at least partially seals the container upon withdrawal of an applicator from the container.

According to another embodiment of the invention, there is provided a packaging assembly comprising a container installed with a wiper of the present disclosure. The packaging assembly further comprises an applicator for applying the cosmetic product stored in the container. The container comprises a receptacle and a neck. The applicator comprises a cap, a stem and an application means. The cap has a suitable locking mechanism to close the container by engaging with the neck of the container. The stem has a proximal end and a distal end. The stem is connected to the application means at its distal end and to the cap at its proximal end. The receptacle has an open end and a closed end thereby forming a cavity for storage of the cosmetic product. The wiper of the present disclosure is installed/located within the opening/neck of the receptacle. The wiper has a proximal and a distal end. Further, the wiper comprises an upper part and a lower part. The lower part is a sealing part which at least partially seals the container to restrict air from getting inside the container when the applicator is removed from the container. According to another embodiment, the sealing part completely seals the container to prevent air from getting inside the container when the applicator is removed from the container.

According to an embodiment of the present invention, there is provided a wiper for container; wherein the wiper has a tubular body having a proximal and a distal end. The wiper further comprises an upper part and a lower part extending downwardly from the upper part, and wherein the lower part is a sealing part that seals the distal end of the wiper. At least one wiping lip having a wiping orifice is defined inside the tubular body of the wiper between the proximal end of the wiper and the distal end of the wiper. The upper part has attachment means for securing the wiper to a neck of the container.

According to yet another embodiment of the present disclosure there is provided a wiper comprising an upper part and a lower part, and wherein the upper part is a wiping part and the lower part is a sealing part. The wiping part has a tubular structure having an opening therein defining a wiping orifice for wiping the applicator. The sealing part extends from the wiping part towards the distal end of the wiper. The sealing part is made of a resilient material having at least two resilient and opposing side-walls that are substantially in physical contact with each other, at least in part. In a closed state/non-deformed state/relaxed state of the sealing part, the sidewalls converge towards a central longitudinal axis of the wiper and free ends of adjacent sidewalls abut each other to form a seal at the distal end of the wiper.

According to one embodiment, the sealing part comprises three resilient and opposing side-walls that are substantially in physical contact with each other, at least in part. In a closed state/non-deformed state/relaxed state of the sealing part, the sidewalls converge towards a central longitudinal axis of the wiper and free ends of adjacent sidewalls abut each other to form a Y-shaped seal at the distal end of the wiper. The Y-shaped seal is formed in a plane perpendicular to a central longitudinal axis of the wiper. In an open/deformed state, the sidewalls are deflected away from the central longitudinal axis of the wiper such that their free ends move apart to provide a suitable opening for insertion of the applicator. The sealing part of the wiper is biased towards a closed state/relaxed state and therefore, the sealing part immediately, at least partially seals the container upon removal of the applicator from the container. This helps in increasing the life of the product by preventing drying out of the product stored within the container and thereby allowing it to remain in its original fluid state.

According to another embodiment of the present disclosure, the wiping part and the sealing part are constructed separately and then assembled together to form the wiper of the present disclosure. Further, the wiping part and the sealing part are made up of at least two different materials. The at least two materials differ in physical and/or chemical properties. The at least two materials may have same chemical nature but have different color and/or texture and/or hardness.

As used herein, the term 'same chemical nature' means that the at least two materials may belong to a same family of polymer, for example an elastomer or a thermoplastic elastomer. Within a family they may correspond to polymers obtained from the same monomer or type of monomer, or the same monomers or same type of monomers, being in this case copolymers. The copolymers of the same chemical nature may differ by the special distribution of the monomers, being alternating or statistical copolymers, and/or by the proportions of the monomers in the copolymers. The copolymers of the same chemical nature may differ by the special distribution of the monomers, being alternating or statistical copolymers, and or by the proportions of the monomers in the copolymers. Within a family, the two materials may correspond to polymers having a same backbone with different and/or identical lateral chains and/or substituents. Within a family they may correspond to different grades, due for example to different degree of cross linking and/or a different degree of polymerization. The two materials may differ by their additive(s) and/or plasticizer(s), and/or may comprise a same additive and/or plasticizer in different quantity.

The at least two materials may each comprise the two same polymers, but in different proportions, having different hardnesses. The two materials may be, for example two polyesters, having different hardnesses. Examples of suitable materials include polyester elastomers, such as, for example HYTREL™ 40 Shore A and HYTREL™ 70 Shore A; polyether block amides such as two different grades of PEBAX™; two different polyolefins, for example with the same number of carbons; or two different polyamides, for example two grades of NYLON™. The use of two materials of the same chemical nature may facilitate the molding of the wiper, the compatibility between both materials being greater due to their same chemical nature. Preferably, the wiping part is fabricated from rigid/semi-rigid plastics such as LDPE, PP and the like; and the sealing part is preferably fabricated from a resilient material such as a thermoplastic elastomer (e.g., TPE), silicon, rubber and the like.

According to an embodiment of the present disclosure, the sealing part is secured to an outer surface of the wiping part. The sealing part has an annular projection and an annular groove on its inner surface that mate with a corresponding annular groove and a corresponding annular projection present on the outer surface of the wiping part. However, it is not beyond the ambit of the present disclosure that the sealing part of the wiper may be secured to wiping part by snap-fitting, gluing, ultra-sonic welding or by any alternative securing means known in the art.

According to an embodiment of the present disclosure there is provided a wiper for a container. The wiper comprises a wiping part and a sealing part. The wiping part is a hollow cylindrical body having at least one wiping orifice. According to a preferred embodiment of the present disclosure, the wiping part has a cylindrical upper portion and a conically tapered lower portion. Further, the lower portion of the wiping part has a wiping orifice. The sealing part of the wiper is attached to and extends from an outer surface of the wiping part. The sealing part of the wiper is a self-sealing resilient structure which seals or at least partially seals the container as the applicator is withdrawn from the container to prevent air from getting inside the container. The sealing part comprises an upper portion which is cylindrical in shape. The lower portion of the sealing part has at least two resilient and opposing sidewalls that extend from the cylindrical upper portion of the sealing part. The at least two resilient sidewalls extend inwardly and downwardly from the upper portion of the sealing part towards a central longitudinal axis of the wiper such that the free ends of the adjacent sidewalls abut each other at a distal end of the sealing part. Each sealing wall has a recessed portion on its outer surface; preferably, the sealing walls are inwardly curved. The at least two resilient sidewalls of the sealing part are biased towards a closed state, i.e. the at least two resilient sidewalls are biased to converge towards each other to meet substantially towards the central longitudinal axis such that free ends of adjacent sidewalls abut each other and define a slit at a distal end of the sealing part to seal or at least partially seal the container. In an open state of the sealing part the at least two resilient sidewalls are diverged away from the central longitudinal axis and the free ends of adjacent sidewalls are moved apart to provide an opening for inserting the applicator.

According to yet another embodiment of the present disclosure, the sealing part comprises a plurality of resilient sidewalls which extends downwardly and inwardly from the cylindrical upper portion of the sealing part towards the central longitudinal axis of the wiper. Preferably, the sealing part has three resilient sidewalls that converge toward the central longitudinal axis of the wiper such that the free ends of adjacent sidewalls abut one another to form three slits at the distal end of the sealing part. The slits can be opened by inserting the applicator there through. The sealing part of the wiper assumes a non-deformed/closed state when no applicator is inserted through the sealing part and assumes a deformed/open state when an applicator is inserted through the sealing part. When the sealing part is in a non-deformed/closed state, the three resilient sidewalls of the sealing part are curved such that inner surfaces of the three resilient sidewalls present convex faces and outer surfaces present concave faces. Further, the free ends of the adjacent sidewalls abut one another ensuing complete closure or sealing of the container. In deformed or open state of the sealing part, the convex faces of the three sidewalls are distorted by the applicator forcing the free ends of the three resilient sidewalls to move apart and provide an opening for insertion of the applicator through the sealing part of the wiper.

According to another embodiment of the present disclosure, the lower portion of the sealing part may have a plurality of longitudinal ribs which extend from an upper portion of sealing part to a distal end of the sealing part. The ribs provide additional structural strength to the sidewalls and bias the sidewalls of the sealing part in closed position. Thus, the ribs provide additional dimensional stability and resilience over an extended period of time.

According to an embodiment of the present disclosure, during use, the sealing part of the wiper is in a closed state in an initial position. As the stem and the application means of the applicator are inserted into the container through the sealing part of the wiper, the application means contacts the convex faces of the side walls of the sealing part causing the convex faces of the sidewalls to distort and force the free ends of the sidewalls to move apart to provide an opening to the applicator. The sidewalls are deflected away from the central longitudinal axis of the wiper. As the application means and the stem are withdrawn from the container, the sidewalls converge towards the central longitudinal axis of the wiper under their own resilience and the free ends of the adjacent sidewalls abut each other to close the opening. Thus, the sealing part restricts outside air from getting inside the container and contaminating the cosmetic product.

According to an embodiment of the present disclosure, the opening of the lower portion of the sealing part may provide a primary wiping to the application means and the stem for removing excess bulk adhering there to. However, the primary wiping provided by the opening of the sealing part is non-uniform and may not be very effective. An effective and uniform wiping of the stem and the application means of the applicator is provided by the wiping orifice of the wiping part. Further, the shape and size of opening provided by the lower portion of the sealing part to the applicator will depend on the shape and size of the application means and the stem of the applicator inserted there through.

According to yet another embodiment of the present disclosure, the slits in the sealing part are formed during molding of the sealing part.

According to yet another embodiment of the present disclosure, the sealing part may be molded without slits at its distal end. The slits are formed by post operation methods after molding of the sealing part, by cutting slits at the distal end of the sealing part using a cutting tool.

According to yet another embodiment of the present disclosure, the sealing part may be molded without slits at its distal end. When the wiper comprising the sealing part is inserted in to neck of the container it seals the container and keeps its integrity intact even without a cap or a dummy cap on the container or at least partially seals the container. This prevents the air from getting inside the container before a first use of the container. This is particularly advantageous as the container does not require a cap and therefore applicator may be sold separately from the container. The sealing part has a substantially continuous elastomeric surface at the distal end. The substantially continuous elastomeric surface defines areas of weakness which can be punctured using a suitable tool such as an applicator comprising an application means and a stem Upon a first time insertion of the applicator along the longitudinal axis of the wiper, the applicator comes in contact with the substantially continuous elastomeric surface and punctures it along areas of weakness to create a desired shape and diameter of resilient opening at the distal end. The shape and size of the opening of the sealing part is therefore customizable depending upon diameter and shape of the applicator or any other suitable tool inserted through it. Further it is possible to use increasing sizes of applicator or suitable tools to create increasing sizes of openings that are resilient.

According to yet another embodiment of the present disclosure, the wiper is molded as a single part without the wiping orifice in the wiping part, and without the slits in the sealing part. The sealing part has a substantially continuous elastomeric surface at the distal end which is punctured along areas of weakness using an applicator to get a resilient opening of desired shape and size. The resilient opening defines the wiping orifice for the wiper. This results in achieving a good seal with the stem and the application means, and the ability of good control of the amount of cosmetic product carried by the applicator.

In preferred embodiments, a groove is provided in the stem and the free ends of the sidewalk of the sealing part of the wiper rest on the groove in the stem, thereby keeping the sealing part in position of minimum stress during the storage of the applicator in the container. The sides of the groove slope relatively shallowly to allow the sidewalls to diverge away gently as the stem and the application means are removed from the container.

According to an embodiment of the present disclosure, the wiping part may have one or more wiping orifice.

According to another embodiment of the present disclosure, the wiping orifice of the wiping part may be circular, or in a variant it may be non-circular, e.g. oval, elliptical, or polygonal. The shape of the wiping orifice may be selected as a function of the shape of the cross-section of the stem and as a function of the manner in which the applicator is taken out from a receptacle of the container, for example whether it turns about its own axis or not.

According to yet another embodiment of the present disclosure, the wiping part and the sealing part of the wiper are fitted together to provide a wiper having a substantially uniform shape.

According to yet another embodiment of the present disclosure, the sealing part has a cylindrical upper portion made of a rigid material. The lower portion is made of a soft material. The upper portion and the lower portion of the sealing part may be obtained from a bi-injection, co-injection or over-molding fabrication technique.

The upper portion of the wiping part has a diameter larger than an outer diameter of the application means such that the application means can be easily withdrawn there from. The wiping orifice has a diameter less than the diameter of the stem for effective wiping of excess cosmetic product adhering to the stem and the application means.

In alternate embodiment of the present disclosure, the sealing part may be designed so as to act as sealing part, and as well as a wiping part. The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the invention may admit to other equally effective embodiments.

Figure 1:
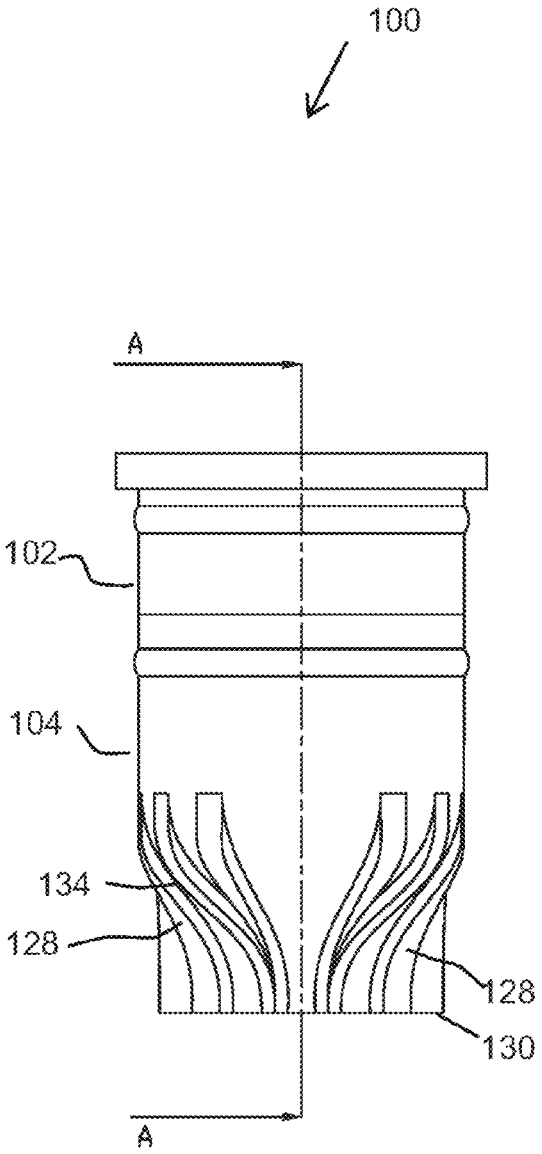
FIG. 1 illustrates a front view of a wiper according to an embodiment of the present disclosure.
Figure 2:
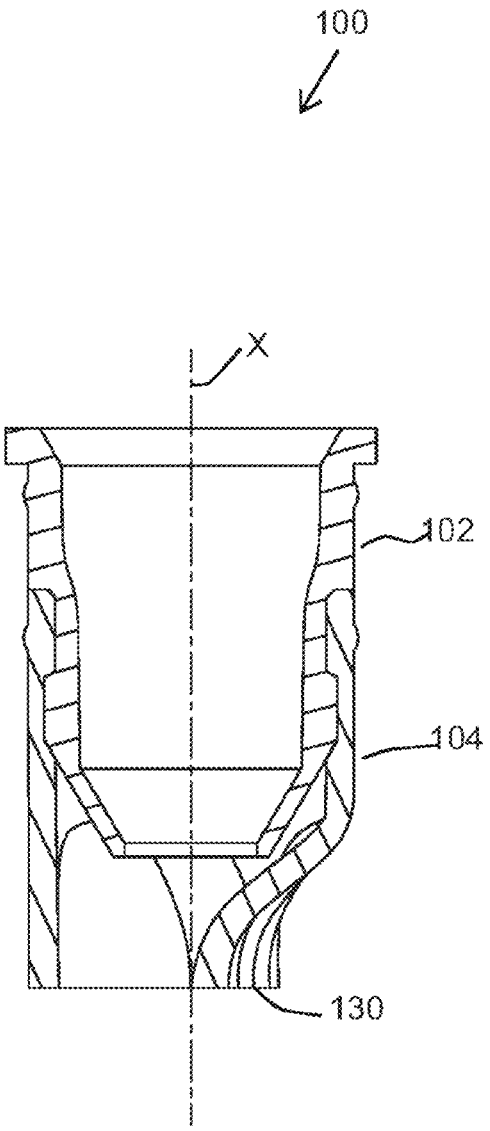
FIG. 2 is a cross-sectional view taken along line A-A of the wiper of FIG. 1.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

A wiper (100) of a container according to one embodiment of the present disclosure is shown in FIGS. 1 to 6. As embodied and shown in FIGS. 1 to 6, the wiper (100) of the present disclosure comprises an upper part (102) for securing the wiper (100) to the container and a lower part (104).

According to an embodiment and as shown in FIGS. 1 to 6, the upper part (102) is a wiping part and hereinafter referred to as a wiping part (102). The lower part (104) is a sealing part and hereinafter referred to as a sealing part (104).

The wiping part (102) and the sealing part (104) are constructed separately and then assembled together to form the wiper (100). According to an embodiment of the present disclosure, the wiping part (102) and the sealing part (104) are made of at least two different materials. The at least two materials differ in physical and/or chemical properties. The at least two materials may have same chemical nature but have different color and/or texture and/or hardness.

As used herein, the term 'same chemical nature' means that the at least two materials may belong to a same family of polymer, for example an elastomer or a thermoplastic elastomer. Within a family they may correspond to polymers obtained from the same monomer or type of monomer, or the same monomers or same type of monomers, being in this case copolymers. The copolymers of the same chemical nature may differ by the special distribution of the monomers, being alternating or statistical copolymers, and/or by the proportions of the monomers in the copolymers. Within a family, the two materials may correspond to polymers having a same backbone with different and/or identical lateral chains and/or substituents. Within a family they may correspond to different grades, due for example to different degree of cross linking and/or a different degree of polymerization. The two materials may differ by their additive(s) and/or plasticizer(s), and/or may comprise a same additive and/or plasticizer in different quantity. In one embodiment, the upper portion of the sealing part is made of a rigid material and the lower portion is made of a soft material.

The at least two materials may each comprise the two same polymers, but in different proportions, having different hardnesses. The two materials may be two polyesters having different hardnesses, for example HYTREL™ 40 Shore A and HYTREL™ 70 Shore A; two polyether block amides such as two different grades of PEBAX™; two different polyolefins, for example with the same number of carbons: or two different polyamides, for example two grades of NYLON™. The use of two materials of the same chemical nature may facilitate the molding of the wiper, the compatibility between both materials being greater due to their same chemical nature. Preferably, the wiping part (102) is fabricated from rigid/semi-rigid plastics such as LDPE, PP and the like; and the sealing part (104) is preferably fabricated from a resilient material such as a thermoplastic elastomer (TPE), silicon, rubber and the like.

Figure 3:
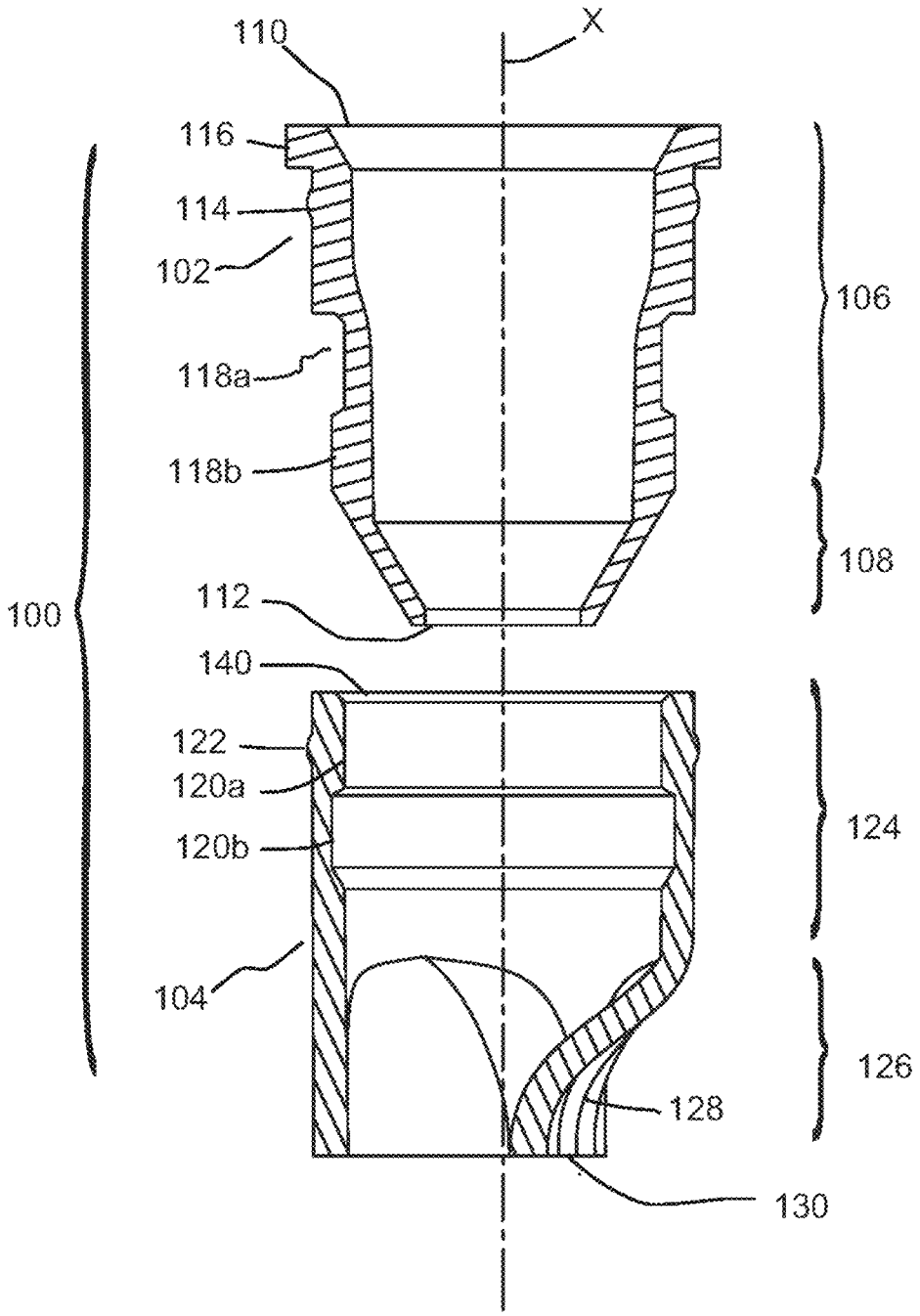
FIG. 3 is an exploded view of the wiper of FIG. 2.

Referring now to FIG. 3, there is shown an exploded view of the wiper (100) illustrating the wiper (100) in greater detail. As seen in FIG. 3, the wiping part (102) of the wiper (100) is a hollow cylindrical body. According to a preferred embodiment, the wiping part (102) comprises a cylindrical upper portion (106) and a conically tapered lower portion (108). The upper portion (106) terminates in an upper orifice (110) and the lower portion (108) terminates in a lower orifice (112) which is a wiping orifice. In an alternate embodiment, the lower orifice (112) may not be a wiping orifice. The sealing part (104) has a cylindrical upper portion (124) and a substantially frusto-conical lower portion (126). In one embodiment, the upper portion (124) of the sealing part (104) is made of a rigid material and the lower portion (126) is made of a soft material. The upper portion (124) terminates in an upper orifice (140). The sealing part (104) is attached onto an outer surface of the wiping part (102) and extends downwardly from the outer surface of the wiping part (102). Further, the upper portion (106) of the wiping part (102) includes an annular groove (118 *a*) and an annular projection (118 *b*) on its outer surface that are shaped to mate with a corresponding annular projection (120 *a*) and a corresponding annular groove (120 *b*) present on an inner surface of the sealing part (104) for securing the sealing part (104) to the wiping part (102). However, it is not beyond the ambit of the present disclosure that the sealing part (104) of the wiper (100) may be secured to the wiping part (102) by snap-fitting, gluing or by any alternative securing means known in the art.

The upper portion (106) of the wiping part (102) further includes attachment features such as a circumferential retention bead (114) and an annular flange (116), and similarly the upper portion (124) of the sealing part (104) includes a retention bead (122). The purpose of these attachment features will be discussed later on.

The sealing part (104) of the wiper (100) has a self-sealing resilient structure. The self-sealing resilient structure of the sealing part (104) is present at the lower portion (126) of the sealing part (104) which comprises at least two resilient and opposing sidewalls (128), more preferably three resilient sidewalk (128), that project inwardly and downwardly from the upper portion (124), towards a central longitudinal axis X of the wiper (100).

FIGS. 1 to 5 illustrate the wiper (100) of the present disclosure having a sealing part (104) in a closed state/non-deformed state. In the closed state of the sealing part (104), each of the sidewalls (128) is curved such that an outer surface of each of the sidewall (128) is concave and an inner surface of each of the sidewall (128) is convex. The three sidewalls (128) meet at a distal end (130) of the sealing part (104). At the distal end (130) of the sealing part (104), free ends (129) of each of the three sidewalls (128) abut one another to form a seal.

Figure 4:
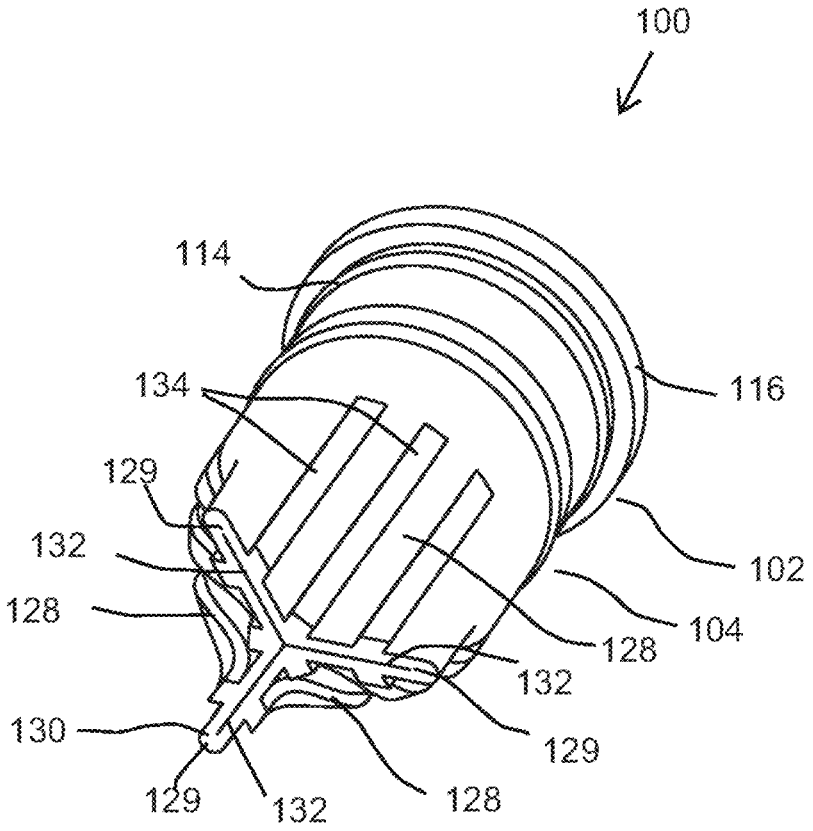
FIG. 4 illustrates a perspective bottom view of the wiper of FIG. 1.
Figure 5:
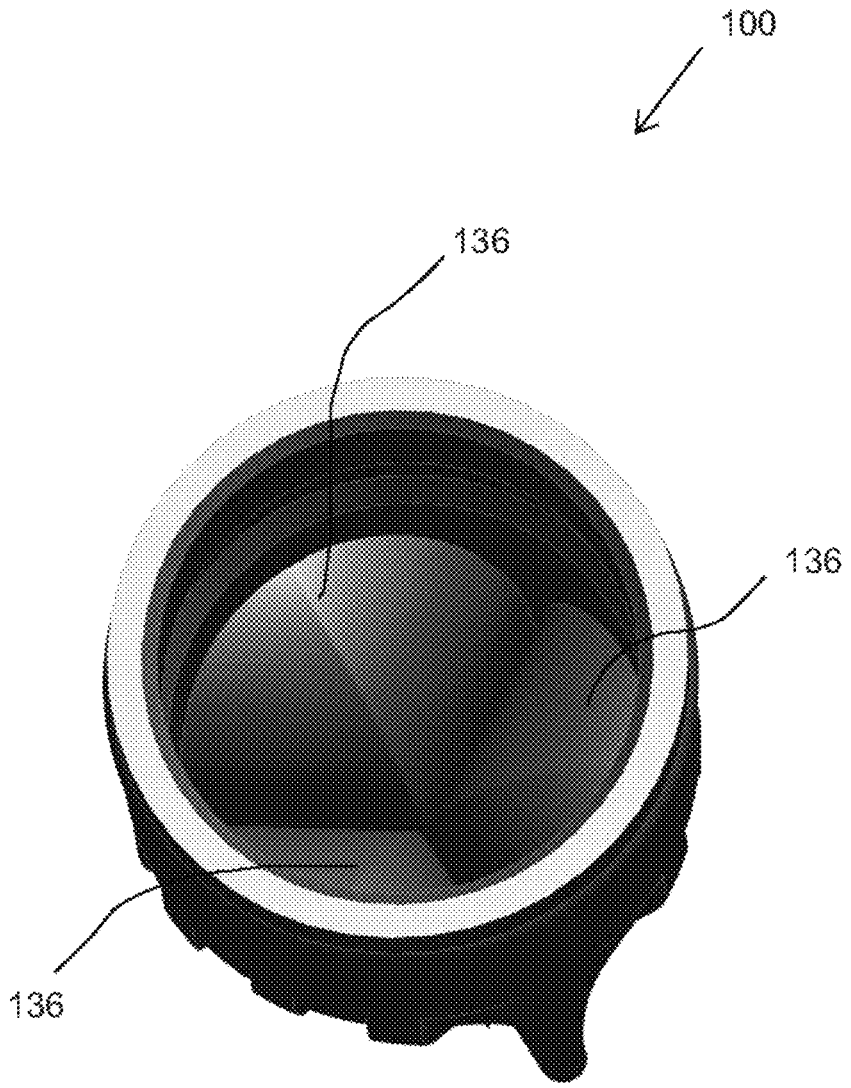
FIG. 5 illustrates a top view of wiper of FIG. 4.

As seen in FIG. 4, each of the three sidewalls (128) has a free end (129) which abuts free end (129) of at least one adjacent sidewall (128) at a distal end (130) of the sealing part (104) such that slits (132) are formed between the free ends (129) of adjacent sidewalls (128). The three sidewalls (128) of the sealing part (104) are curved, with their free ends (129) abutting to dose the sealing part (104) at the distal end (130). Preferably, the free ends (129) of the adjacent sidewalls (128) come together to form a Y-shaped seal at the distal end (130). Further, the sidewalls (128) have a plurality of longitudinal ribs (134) which extend from the upper portion (124) of the sealing part (104) to the distal end (130) of the sealing part (104). These ribs (134) provide additional structural strength to the sidewalls (128) and bias the sidewalls (128) of the sealing part (104) in the closed state. Thus, the ribs (134) ensure additional dimensional stability and resilience over an extended period of time. In the closed state/non-deformed state and as seen in FIG. 5, the inner surfaces of each of the three sidewalls (128) of the sealing part (104) present a convex face (136) inside the wiper (100).

Figure 6:
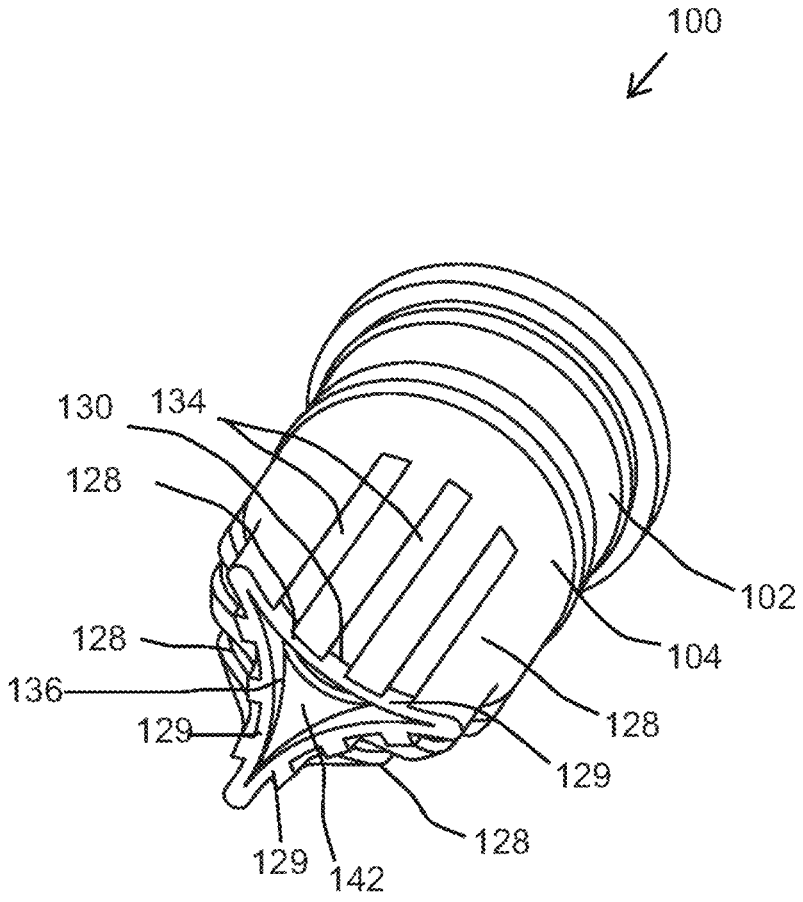
FIG. 6 illustrates the wiper of FIG. 4 in an open state.

Referring now to FIG. 6, the sealing part (104) of the wiper (100) is illustrated in an open state/deformed state (applicator is not shown for ease of understanding). As seen in FIG. 6, the free ends (129) move apart to provide an opening (142) when the sealing part (104) of the wiper (100) is in an open state. In deformed or open state of the wiper (100), the free ends (129) of the sidewalls (128) move apart to provide an opening (142) for insertion of an applicator. The shape and size of the opening (142) depends on the shape and size of the applicator which is inserted through the sealing part (104). The opening (142) is closed and the free ends (129) of the adjacent sidewalls (128) abut one another, when the sealing part (104) is in a closed state/non-deformed state.

FIGS. 7A to 7D illustrate a packaging assembly (200) comprising a container (201) installed with the wiper (100) according to an embodiment of the present disclosure. The packaging assembly (200) further comprises an applicator (202). The container (201) comprises a receptacle (201*a*) and a neck (208). The applicator (202) comprises a cap (204), a stem (205) and an application means (206). The cap (204) has a suitable locking mechanism to close the container (201) by engaging with the neck (208) of the container (201). The stem (205) has a proximal end and a distal end. The stem (205) is connected to the application means (206) at its distal end and to the cap (204) at its proximal end. The receptacle (201*a*) has an open end and a closed end thereby forming a cavity for storage of product. The container (201) further comprises the wiper (100) fitted onto the neck (208) of the container (201). The circumferential retention bead (114) of the wiping part (102) and the retention bead (122) of the sealing part (104) of the wiper (100) fits into a complimentary groove (210*a*) and (210*b*) respectively located on an inner wall of the neck (208) of the container (201). The beads (114), (122) and grooves (210*a*), (210*b*) stabilize the wiper (100) in the neck (208) by opposing any movement of the wiper (100), as for example, when the applicator (202) passes through the wiper (100). The lower portion (108) of the wiping part (102) of the wiper (100) is conically tapered such that it has a smaller diameter than that of the upper portion (106) of the wiping part 102. The upper portion (106) of the wiping part (102) has a diameter larger than the outer diameter of the application means (206) so that the application means (206) can be easily withdrawn therefrom, and the lower orifice (112) has a diameter less than the diameter of the stem (205) of the applicator (202) for effective wiping of the stem (205) and the application means (206).

Figure 7A:
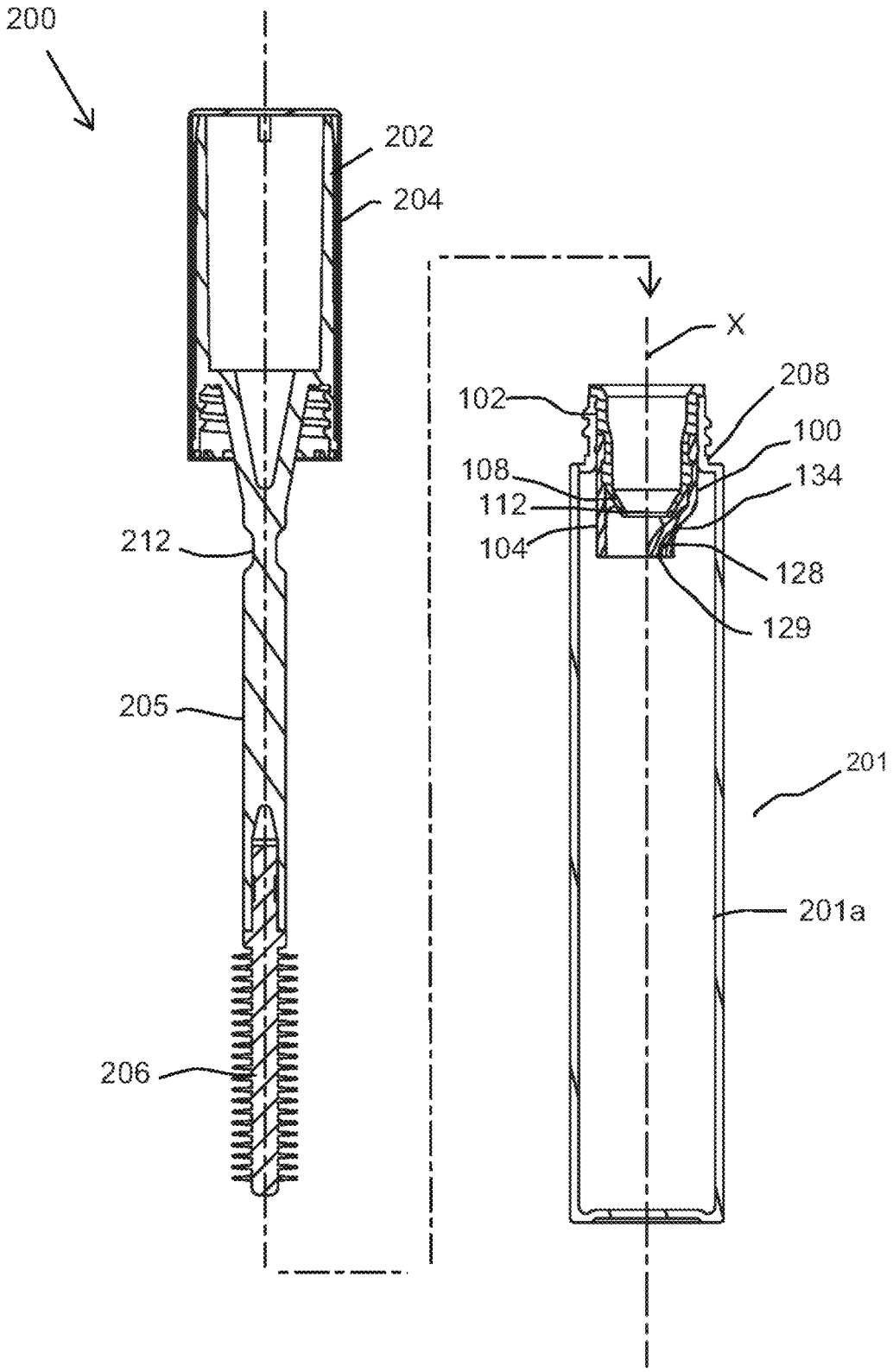
FIG. 7A illustrates a cross-sectional view of a packaging assembly showing the wiper of FIG. 1 installed in a container with an applicator positioned to be inserted into the container.

FIG. 7A, shows the wiper (100) in an initial position where the sealing part (104) of the wiper (100) is in a closed state. The resilient sidewalls (128) of the sealing part (104) are curved, preferably are curved toward the central longitudinal axis X, with their free ends (129) abutting one another to close distal end (130) of the sealing part (104).

Figure 7B:
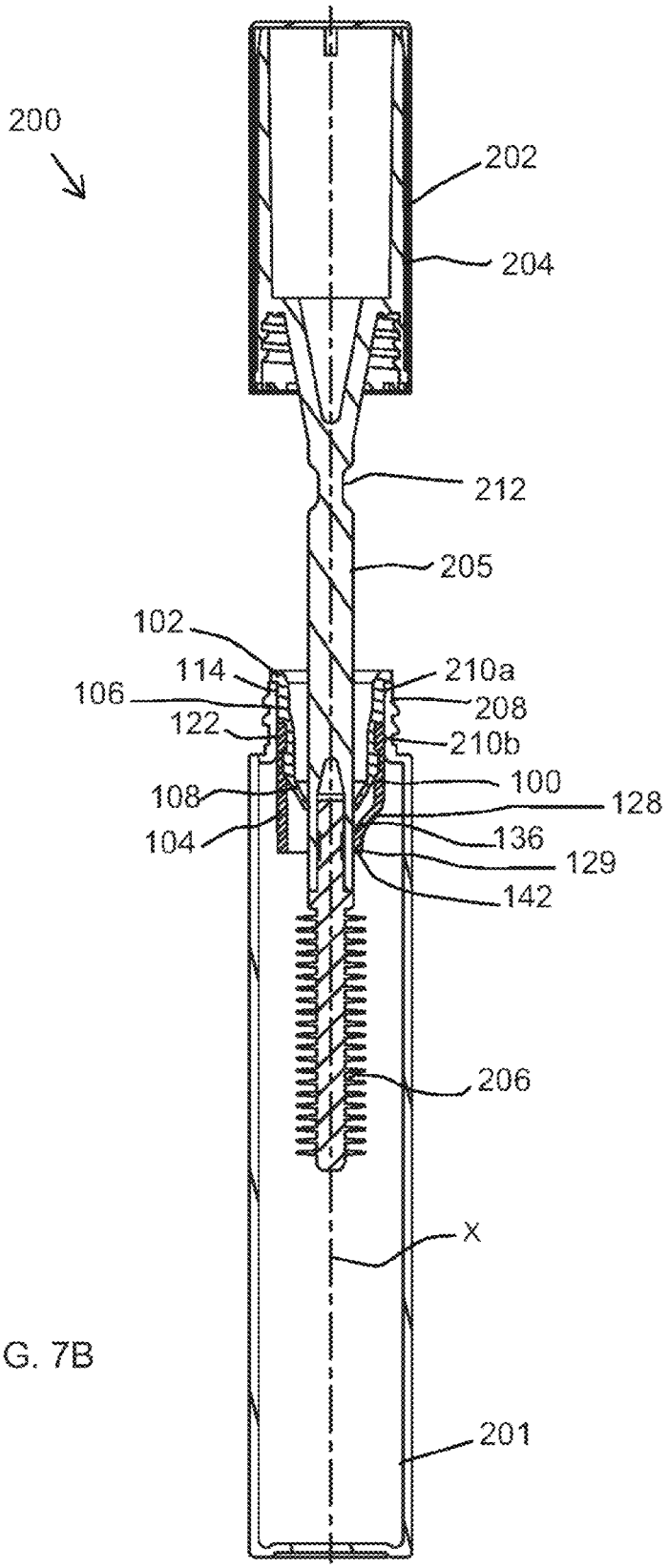
FIG. 7B illustrates a cross-sectional view of the packaging assembly of FIG. 7A showing the applicator being inserted into the container according to an embodiment of the present disclosure.

As seen in FIG. 7B, as the stem (205) and the application means (206) are inserted in the container (201) through the sealing part (104) of the wiper (100), the application means (206) contacts the convex faces (136) of the sealing part (104) causing the convex faces (136) to distort and forcing the free ends (129) of the sidewalls (128) to move apart to provide an opening (142) to the applicator (202) for insertion there through. Further, the size of the opening (142) provided by the lower portion (126) of the sealing part (104) will depend on the shape and size of the application means (206) and the stem (205) of the applicator (202) inserted there through.

Figure 7C:
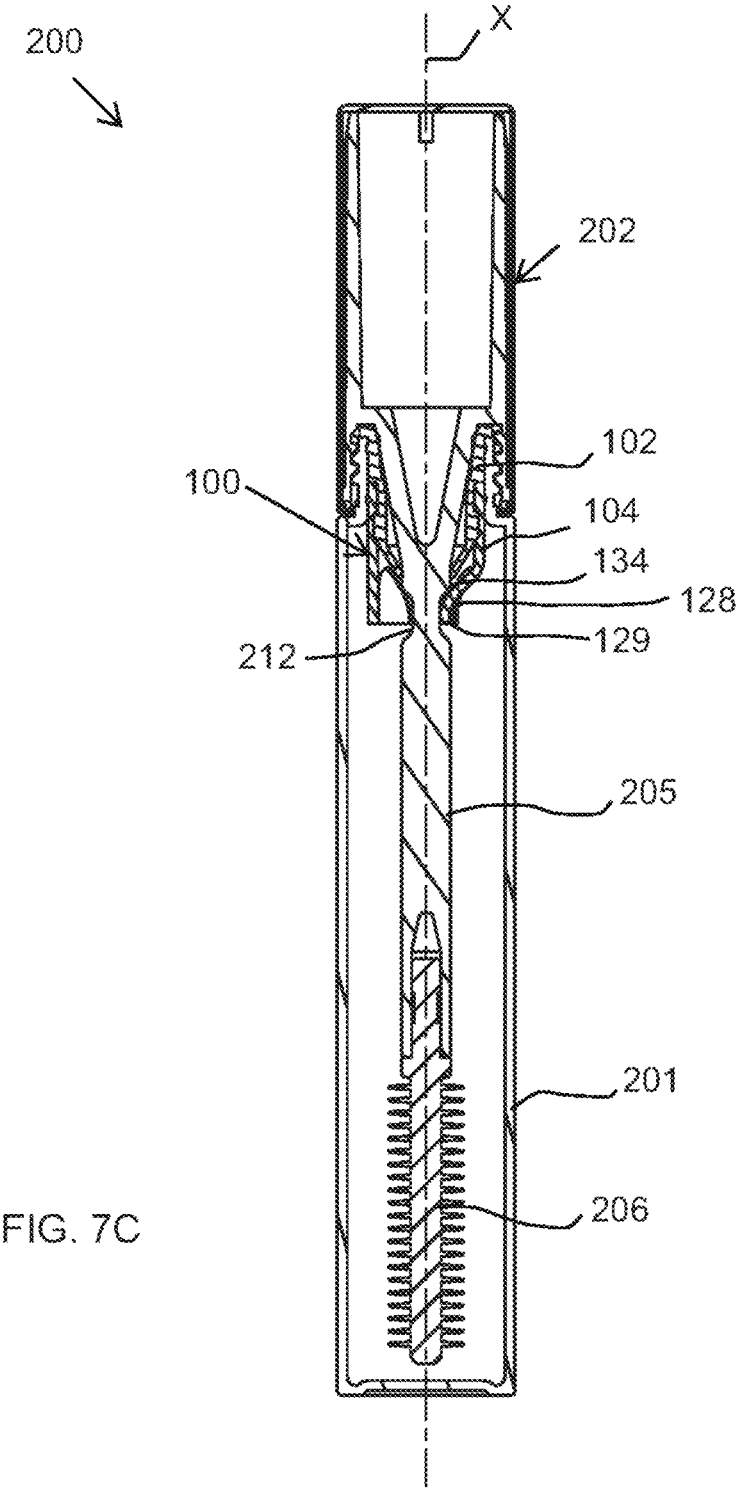
FIG. 7C illustrates a cross-sectional view of the packaging assembly of FIG. 7A with the applicator completely inserted inside the container.
Figure 7D:
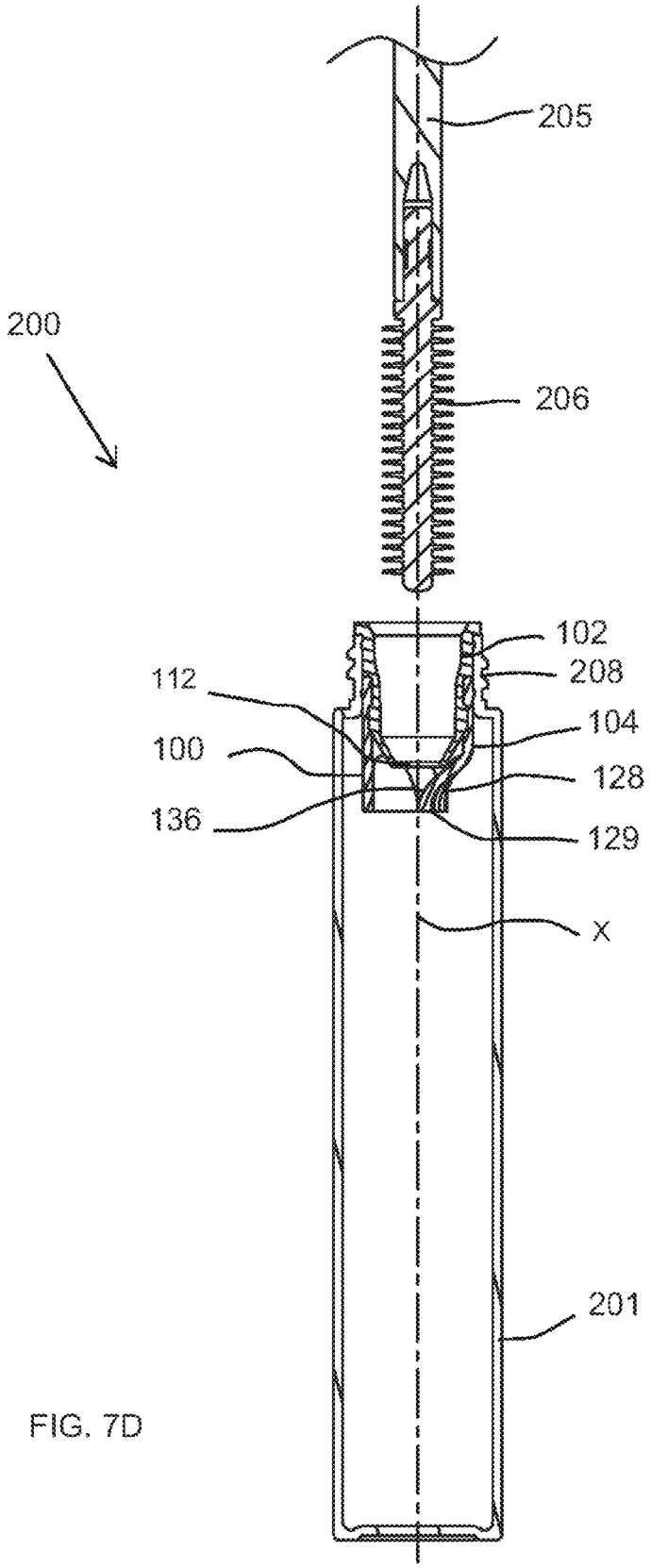
FIG. 7D illustrates a cross-sectional view of the packaging assembly of FIG. 7A when the applicator is completely withdrawn from the container.

In a preferred embodiment and as shown in FIG. 7C, a groove (212) is provided in the stem (205) and the sidewalls (128) rest in the groove (212) of the stem (205) when the applicator (202) is completely inserted in the container (201). The presence of the groove (212), keeps the sealing part (104) of the wiper (100) in position of minimum stress during storage of the applicator (202) in the container (201). The sides of the groove (212) slope relatively shallowly to allow the sidewalls (128) to expand outwards gently as the stem (205) and the application means (206) are removed from the container (201).

As seen in FIG. 70, when the application means (206) and the stem (205) are withdrawn from the container (201), the sidewalls (128) converge towards the central longitudinal axis X of the wiper (100) under their own resilience and the free ends (129) of the adjacent sidewalls (128) abut one another to close the opening (142), shown in FIG. 7B. This helps in increasing the life of the product by preventing drying out of the product and allowing it to remain in its original fluid state within the container (201).

According to an embodiment of the present disclosure, the opening (142) of the lower portion (126) of the sealing part (104) may provide a primary wiping to the application means (206) and the stem (205) for removing excess bulk adhering there to. However, the wiping provided by the opening (142) of the sealing part (104) may be non-uniform and weak. An effective and uniform wiping of the stem (205) and the application means (206) of the applicator (202) are performed by the wiping orifice (112) of the wiping part (102) of the wiper (100).

According to an embodiment of the present disclosure, the wiping part (102) may have one or more wiping orifices.

According to another embodiment of the present disclosure, the wiping orifice (112) of the wiping part (102) may be circular, or in a variant it may be non-circular, e.g. oval, elliptical, or polygonal. The shape of the wiping orifice (112) may be selected as a function of the shape of the cross-section of the stem (205) and as a function of the manner in which the applicator (202) is taken out from the receptacle (201*a*), for example whether it turns about its own axis or not.

According to yet another embodiment of the present disclosure, the wiping part (102) and the sealing part (104) of the wiper (100) are fitted together to provide a wiper (100) having a substantially uniform shape.

According to yet another embodiment of the present disclosure, the slits (132) in the sealing part (104) are formed during molding of the sealing part (104).

According to yet another embodiment of the present disclosure, the sealing part (104) may be molded without slits (132) at its distal end (130). The slits (132) are formed post operation by cutting slits at the distal end (130) of the sealing part (104) using a cutting tool.

According to yet another embodiment of the present disclosure, the sealing part (104) may be molded without slits (132) at its distal end (130). When the wiper (100) comprising the sealing part (104) is inserted in to neck of the container (201) it at least partially seals the container (201). According to another embodiment, the sealing part (104) completely seals the container and keeps integrity of container (201) intact. This is particularly advantageous as the container (201) does not require a cap and therefore the applicator (202) may be sold separately from the container (201). The sealing part (104) has a substantially continuous elastomeric surface at the distal end (130). The substantially continuous elastomeric surface defines areas of weakness which can be punctured using a suitable tool such as the application means (206) of the applicator (202). Upon a first time insertion of an applicator (202) along the longitudinal axis of the wiper, the application means (206) comes in contact with the substantially continuous elastomeric surface and punctures it along areas of weakness to create a desired shape and diameter of resilient opening (142) at the distal end (130). The shape and size of the opening (142) of the sealing part (104) is therefore customizable depending upon diameter and shape of the application means (206) or any other suitable tool inserted through it. Further it is possible to use increasing sizes of application means (206) or stem (205) or suitable tools to create increasing sizes of openings that are resilient.

According to yet another embodiment of the present disclosure, the wiper (100) is molded in single part without the wiping orifice (112), and without the slits (132) in the sealing part (104). The sealing part (104) has a substantially continuous elastomeric surface at the distal end (130) which is punctured along areas of weakness using an applicator (202) to get a resilient opening (142) of desired shape and size and wherein the resilient opening (142) also defines a wiping orifice of the wiper (100). The resilient opening (142) of the wiper (100) achieves a good seal with the stem (205) and the application means (206), and thus it exhibits good control on the amount of cosmetic product carried by the applicator (202).

The materials suitable for forming the receptacle (201*a*) may be any suitable polymeric material such as polypropylene while the cap (204) may be formed of any suitable polymeric member such as acrylonitrile butadiene styrene. The material of the application means (206) may be any suitable polymeric material as nylon, TPE (Thermoplastic elastomer), TPU (Thermoplastic urethane) or could be a suitable metal, ceramic, glass, stone and the like. The stem (205) may be formed of polyacetal or any other suitable material. The aforementioned materials for forming various parts of the container (201) of the present disclosure are an example, however other suitable materials may also be used. Depending upon the substance being used in the receptacle (201*a*), a variety of sizes and shapes of the application means (206) can be utilized. The application means (206) may be constructed of a porous or non-porous rubber, fabric mesh, felt material, foamed polymers, sponge material, polyester elastomer, HYTREL™, TPE or any other suitable material. Also, the application means (206) could have any suitable shape depending on the kind of application required. It could have a shape other than cylindrical such as ovular, tapered or any other suitable shape.

It will be understood that the foregoing is only illustrative of the principles of the invention, and that various modifications can be made by those skilled in the art without departing from the scope and spirit of the invention. For example, the shapes and/or sizes of various components can be different from the shapes and sizes shown herein. As another example, the materials used for various components can be different from those mentioned specifically herein.

What is claimed is:

1. A wiper for a container, the wiper comprising:

an upper part and a lower part, wherein the lower part is a sealing part;

wherein the sealing part extends from the upper part towards a distal end of the wiper, the sealing part comprises at least three sidewalls;

wherein the sealing part is capable of assuming a closed state and an open state;

wherein in the closed state, the at least three sidewalls converge towards a central longitudinal axis of the wiper such that free ends of adjacent sidewalls of the at least three sidewalls abut each other to form a Y-shaped seal at the distal end of the wiper;

wherein in the closed state, the adjacent sidewalls of the sealing part come together to define slits between the free ends of the adjacent sidewalls;

wherein all the slits meet one another at a point on the central longitudinal axis of the wiper;

wherein in an open state, the at least three sidewalls are deflected away from the central longitudinal axis of the wiper such that their free ends move apart from each other; and wherein the at least three sidewalls are resilient and bias the sealing part towards the closed state.

2. The wiper of claim 1, wherein the upper part and the sealing part are constructed separately and then assembled together to form the wiper.

3. The wiper of claim 2, wherein the sealing part is secured to an outer surface of the upper part and extends downwardly from the outer surface of the upper part.

4. The wiper of claim 3, wherein the sealing part has an annular projection and an annular groove on its inner surface that mate with a corresponding annular groove and a corresponding annular projection present on the outer surface of the upper part.

5. The wiper of claim 2, wherein the upper part and the sealing part are made up of two different materials.

6. The wiper of claim 5, wherein the two materials differ in one of a physical or a chemical property.

7. The wiper of claim 1, wherein the upper part of the wiper comprises a cylindrical upper portion and a conically tapered lower portion, and wherein the lower portion of the upper part defines a wiping orifice.

8. A wiper for a container, the wiper comprising:

an upper part and a lower part wherein the lower part is a sealing part;

wherein the sealing part extends from the upper part towards a distal end of the wiper, the sealing part comprises at least three sidewalls;

wherein the sealing part is capable of assuming a closed state and an open state;

wherein in the closed state, the at least three sidewalls converge towards a central longitudinal axis of the wiper such that free ends of adjacent sidewalls of the at least three sidewalls abut each other to form a Y-shaped seal at the distal end of the wiper;

wherein in an open state, the at least three sidewalls are deflected away from the central longitudinal axis of the wiper such that their free ends move apart from each other;

wherein the at least three sidewalls are resilient and bias the sealing part towards the closed state;

wherein the sealing part comprises an upper portion which is cylindrical in shape and a lower portion comprising the at least three sidewalls; and wherein the at least three sidewalls extend inwardly and downwardly from the cylindrical upper portion of the sealing part, towards the central longitudinal axis of the wiper such that the free ends of the adjacent sidewalls of the at least three sidewalls abut each other at the distal end of the wiper.

9. The wiper of claim 8, wherein the upper portion of the sealing part is made of a rigid material and the lower portion is made of a soft material.

10. A wiper for a container, the wiper comprising:

an upper part and a lower part wherein the lower part is a sealing part;

wherein the sealing part extends from the upper part towards a distal end of the wiper, the sealing part comprises at least three sidewalls;

wherein the sealing part is capable of assuming a closed state and an open state;

wherein in the closed state, the at least three sidewalls converge towards a central longitudinal axis of the wiper such that free ends of adjacent sidewalls of the at least three sidewalls abut each other to form a seal at the distal end of the wiper;

wherein in an open state, the at least three sidewalls are deflected away from the central longitudinal axis of the wiper such that their free ends move apart from each other;

wherein the at least three sidewalls are resilient and bias the sealing part towards the closed state; and wherein the at least three sidewalls are curved such that an inner surface of each of the at least three sidewalls is convex and an outer surface of each of the at least three sidewalls is concave.

11. The wiper of claim 1, wherein the outer surface of each of the at least three sidewalls has at least one longitudinal rib which extends over at least half a length of the at least three sidewalls.

12. The wiper of claim 1, wherein in the open state, the at least three sidewalls form an opening at the distal end of the wiper.

13. A packaging assembly comprising a wiper of claim 1 and wherein the packaging assembly further comprises:

a container having a receptacle and a neck;

an applicator comprises a cap, a stem and an application means;

a distal end of the stem is connected to the application means and a proximal end of stem is connected to the cap; and wherein the wiper is fitted into the neck of the container.

14. The packaging assembly of claim 13, wherein when the applicator is inserted into the container through the sealing part of the wiper, the application means contacts the at least three side walls of the sealing part causing the sidewalls to distort and forcing the free ends of the at least three resilient sidewalls to move apart to provide an opening to the applicator, the sealing part thus assuming the open state.

15. The packaging assembly of claim 14, wherein shape and size of the opening provided by the sealing part for the applicator depends on the shape and size of the application means and the stem of the applicator inserted there through.

16. The packaging assembly of claim 13, wherein when the application means and the stem are withdrawn from the container, the sealing part assumes the closed state.

* * * * *